US007121658B2

(12) United States Patent
Platt et al.

(10) Patent No.: US 7,121,658 B2
(45) Date of Patent: Oct. 17, 2006

(54) PRINT HEAD RESERVOIR HAVING PURGE VENTS

(75) Inventors: David P. Platt, Sherwood, OR (US); Nasser Alavizadeh, Tigard, OR (US); Michael F. Deily, Lake Oswego, OR (US)

(73) Assignee: Xerox Corporation, Stamford, CT (US)

( * ) Notice: Subject to any disclaimer, the term of this patent is extended or adjusted under 35 U.S.C. 154(b) by 245 days.

(21) Appl. No.: 10/753,042

(22) Filed: Jan. 7, 2004

(65) Prior Publication Data

US 2005/0146582 A1 Jul. 7, 2005

(51) Int. Cl.
*B41J 2/175* (2006.01)

(52) U.S. Cl. ..... 347/87; 347/93

(58) Field of Classification Search ..... 347/85, 347/86, 87, 89, 93
See application file for complete search history.

(56) References Cited

U.S. PATENT DOCUMENTS

| | | | | |
|---|---|---|---|---|
| 5,546,109 | A * | 8/1996 | Nakano | 347/93 |
| 5,936,650 | A * | 8/1999 | Ouchida et al. | 347/89 |
| 6,089,686 | A * | 7/2000 | Thornton et al. | 347/7 |
| 6,152,559 | A * | 11/2000 | Kojima | 347/89 |
| 6,752,493 | B1 * | 6/2004 | Dowell et al. | 347/89 |
| 6,755,515 | B1 * | 6/2004 | Usui et al. | 347/86 |

* cited by examiner

*Primary Examiner*—Anh T. N. Vo
(74) *Attorney, Agent, or Firm*—Fay, Sharpe, Fagan, Minnich & Mckee, LLP

(57) ABSTRACT

A print head reservoir for use in an ink jet printer includes a body, an ink bucket, and a filter. The body defines an ink cavity. The cavity includes a cavity inlet, a cavity outlet and a vent positioned above the cavity inlet for bleeding air from the ink cavity. The ink bucket attaches to the body. The ink bucket communicates with the cavity via the cavity inlet. The filter is disposed in the cavity dividing the cavity into an upstream filter cavity and a downstream filter cavity.

19 Claims, 11 Drawing Sheets

PRINT HEAD RESERVOIR HAVING PURGE VENTS

BACKGROUND

Ink jet printers create an image on a surface by ejecting ink through orifices in a print head face plate onto a substrate. The print head face plate communicates with a print head reservoir, which communicates with an ink source. Solid ink printers melt ink and deliver the melted ink to the print head reservoir.

The orifices on the print head face plate are quite small and can be easily obstructed by a small impurity in the ink. Therefore, prior to the ink being delivered to the orifice, the ink is filtered in the print head reservoir. Known print head reservoirs include horizontal filters disposed in the reservoir. These horizontal filters resulted in a wide print head reservoir. Accordingly, it is desirable to provide a more compact print head reservoir.

When the solid printer is turned off, the ink that remains in the print head reservoir can freeze. When the ink thaws in the print head reservoir, air that was once in solution in the ink can come out of solution to form air bubbles or air pockets in the print head reservoir. Large air pockets can impede the filtering of the ink as it travels toward the orifices in the print head face plate. Also, air pockets or bubbles can form in other channels that lead to the orifices. These air pockets and/or air bubbles are purged out of the print head reservoir and it is desirable to provide vents in the print head reservoir that can bleed trapped air out of the ink flow path.

BRIEF DESCRIPTION

A print head reservoir includes a cavity wall that defines a portion of an ink cavity. The cavity wall includes a vent in communication with the ink cavity. The ink cavity is in communication with an ink source via an ink cavity inlet and an ink jet via an ink cavity outlet.

A print head reservoir for an ink jet printer includes a body defining a cavity in communication with an ink source via an ink path. The body includes a vent in communication with the cavity and the ink path such that ink that passes through the vent is recirculated into the ink path.

A print head reservoir for use in an ink jet printer includes a body, an ink bucket, and a filter. The body defines an ink cavity. The ink cavity includes a cavity inlet, a cavity outlet and a vent positioned above the cavity inlet for bleeding air from the ink cavity. The ink bucket attaches to the body. The ink bucket communicates with the cavity via the cavity inlet. The filter is disposed in the cavity dividing the cavity into an upstream filter cavity and a downstream filter cavity.

DETAILED DESCRIPTION

Figure 1:
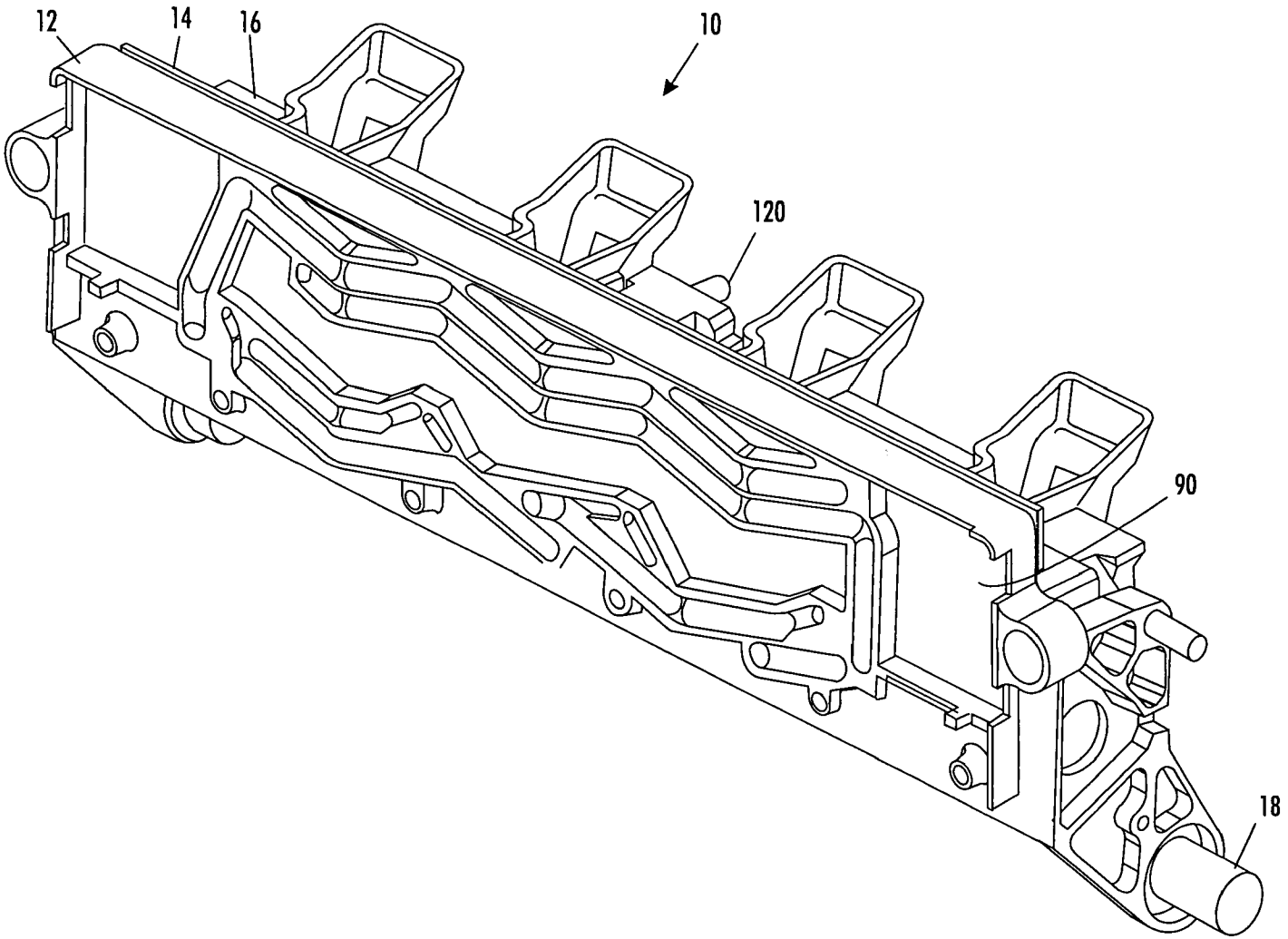
FIG. 1 is a front perspective view of a portion of a print head reservoir for an ink jet printer.
Figure 12:
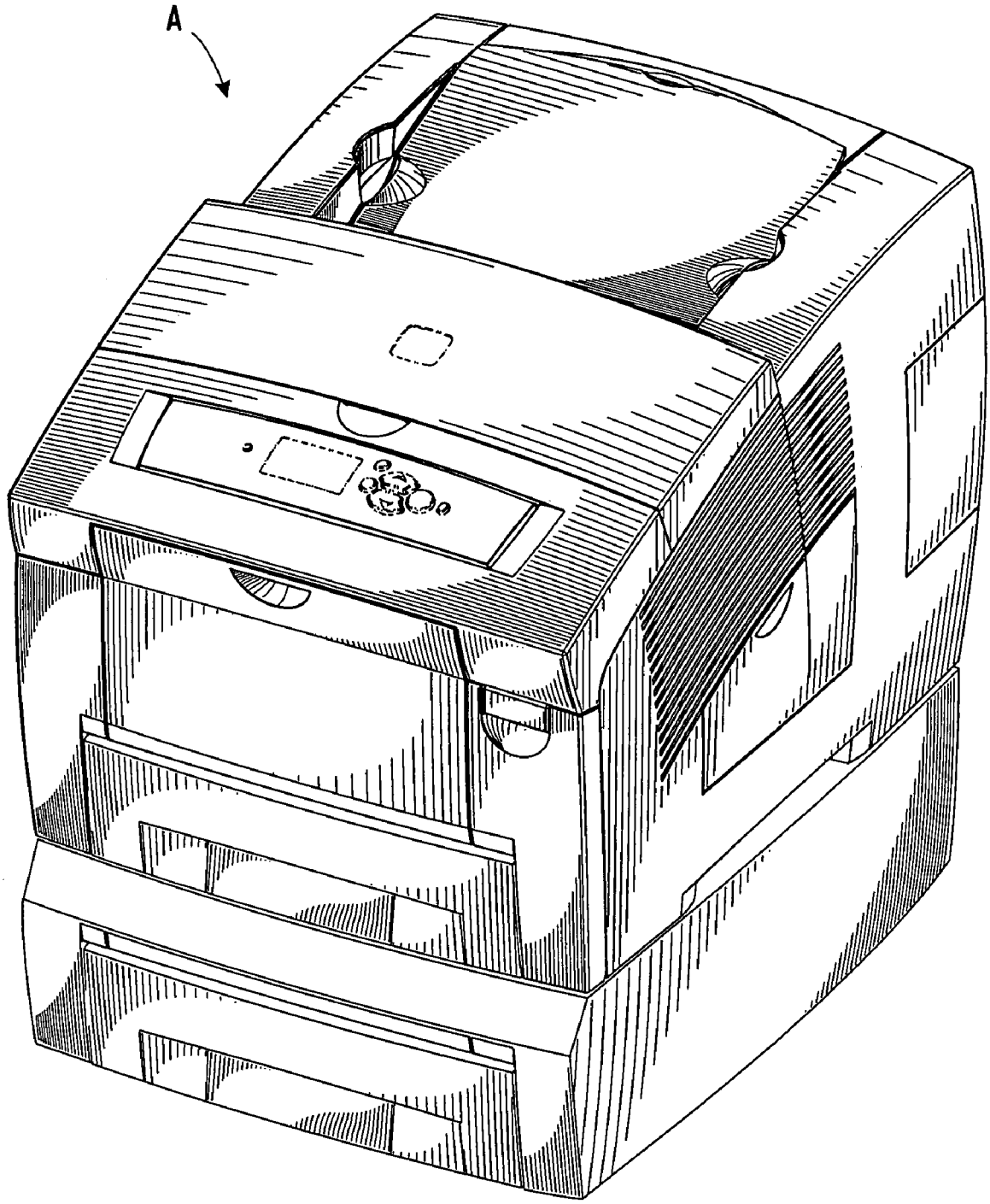
FIG. 12 is a perspective view of an ink jet printer that includes the print head reservoir of FIG. 1.
Figure 13:
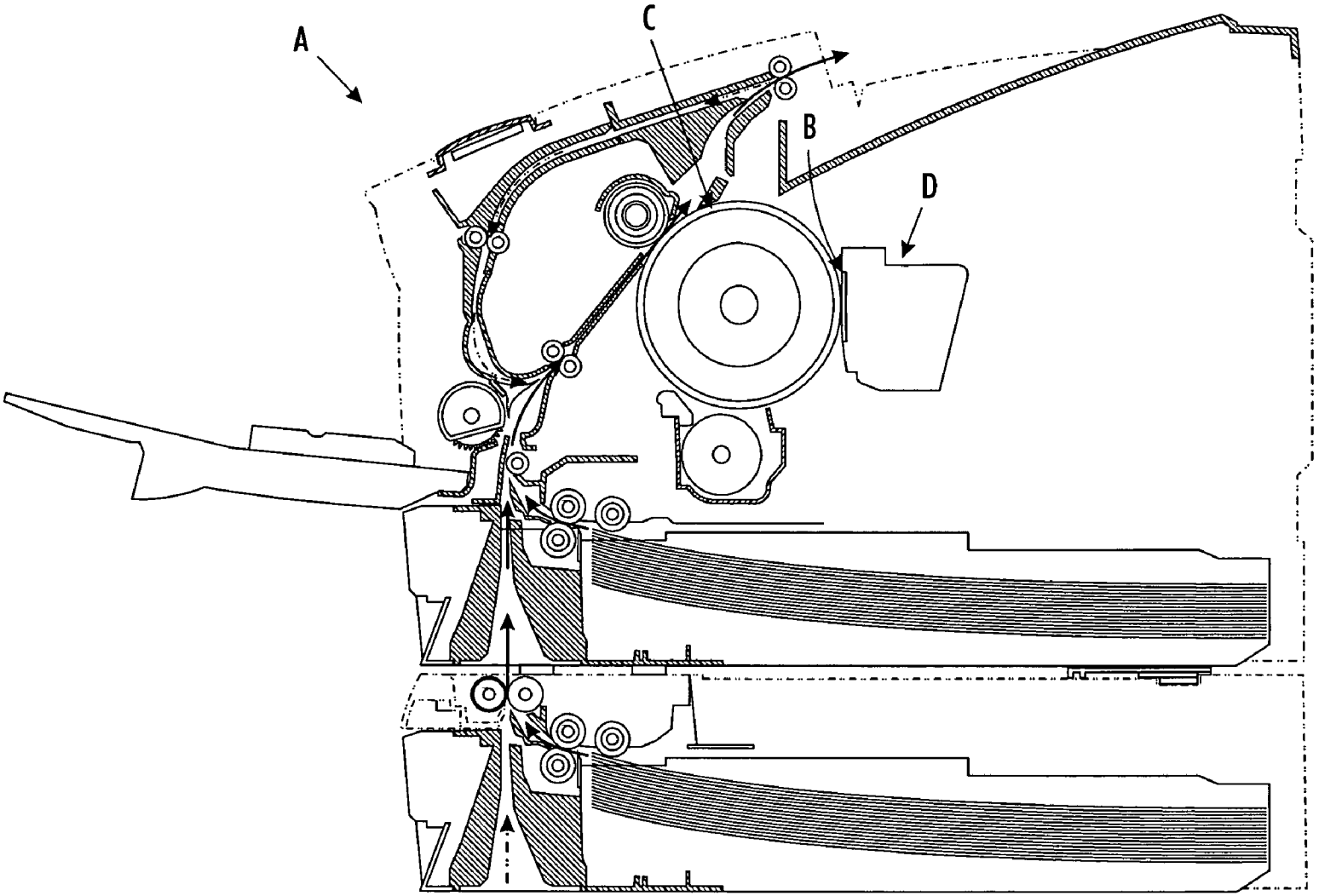
FIG. 13 is a side cross-sectional view of the ink jet printer of FIG. 12.

With reference to FIG. 1, a print head reservoir 10 for an ink jet printer A (FIG. 12) generally delivers liquid ink to a jet stack B (FIG. 13) that transfers the ink onto a drum C (FIG. 13). The print media, which can include paper, travels around the drum and picks up the ink deposited on the drum. The reservoir 10 comprises a portion of a print head D (FIG. 13) and includes a first or front plate 12, a second or middle plate 14 and a third or rear plate 16. The print head reservoir 10 is situated inside the ink jet printer such that the bottom of each plate is substantially horizontal and the reservoir can rotate about a pair of journals 18 (only one visible in FIG. 1). The terms "front," "middle," and "rear" are used for ease of understanding to describe the components of the reservoir as they are shown in the figures; the terms are not used to limit the position of components in relation to one another.

Figure 2:
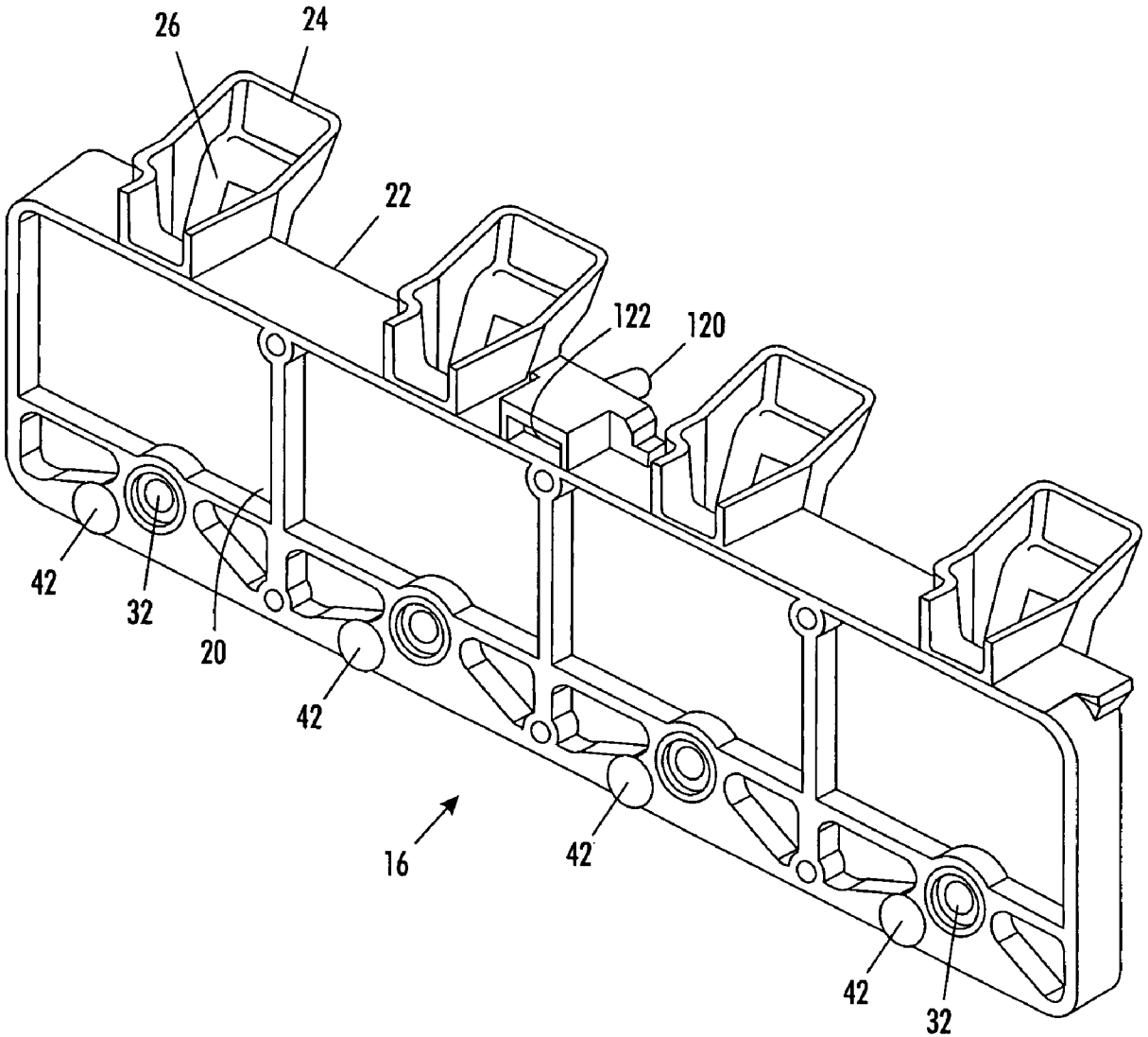
FIG. 2 is a front perspective view of a rear plate of the print head reservoir of FIG. 1.

Generally, the ink travels from the rear plate 16 towards the front plate 12. With reference to FIG. 2, the rear plate includes a front side 20 that is adjacent the middle plate 14 when the reservoir is assembled and a rear side 22 opposite the front side. A plurality of bucket walls 24 extend from the rear side 22 to define a plurality of ink buckets 26. In the embodiment depicted, four ink buckets are shown and each bucket receives a different color ink, particularly yellow, cyan, magenta and black; however, a fewer or greater number of ink buckets can be provided and the ink buckets can receive different colors of ink. The ink buckets 26 usually receive ink that has been melted and dripped into the buckets; however, liquid ink that has not been melted can also be delivered to the ink buckets.

Figure 3:
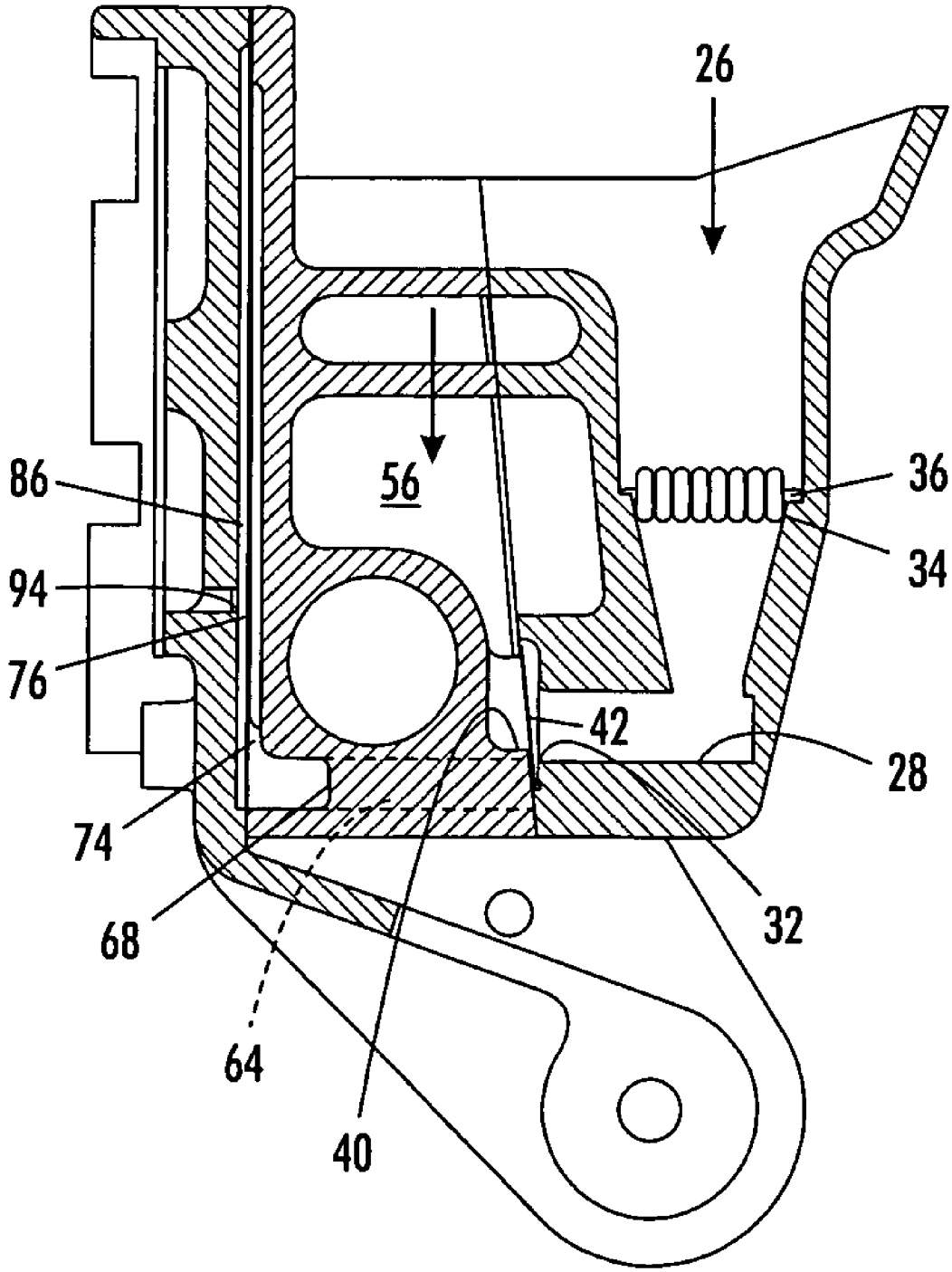
FIG. 3 is a view of a side cross-section of the print head reservoir of FIG. 1.

With reference to FIG. 3, each ink bucket 26 communicates with a passage 28 which communicates with a rear plate outlet 32. A filter 34 is disposed in each ink bucket on a shoulder 36 that projects inwardly from the bucket wall 24 into the ink bucket 26. The filter 34 removes impurities in the ink before the ink travels into the passage 28 and towards the rear plate outlet 32. The rear plate outlet 32 communicates with a middle plate inlet 40 through a valve member 42. The valve member 42 comprises a component of a one-way check valve that allows ink to pass from the rear plate outlet 32 into the middle plate inlet 40. The valve member 42 precludes ink from passing from the middle plate inlet 40 back into the rear plate outlet 32. The valve member 42 opens and closes in response to a pressure differential between the rear plate outlet 32 and the middle plate inlet 40.

Figure 4:
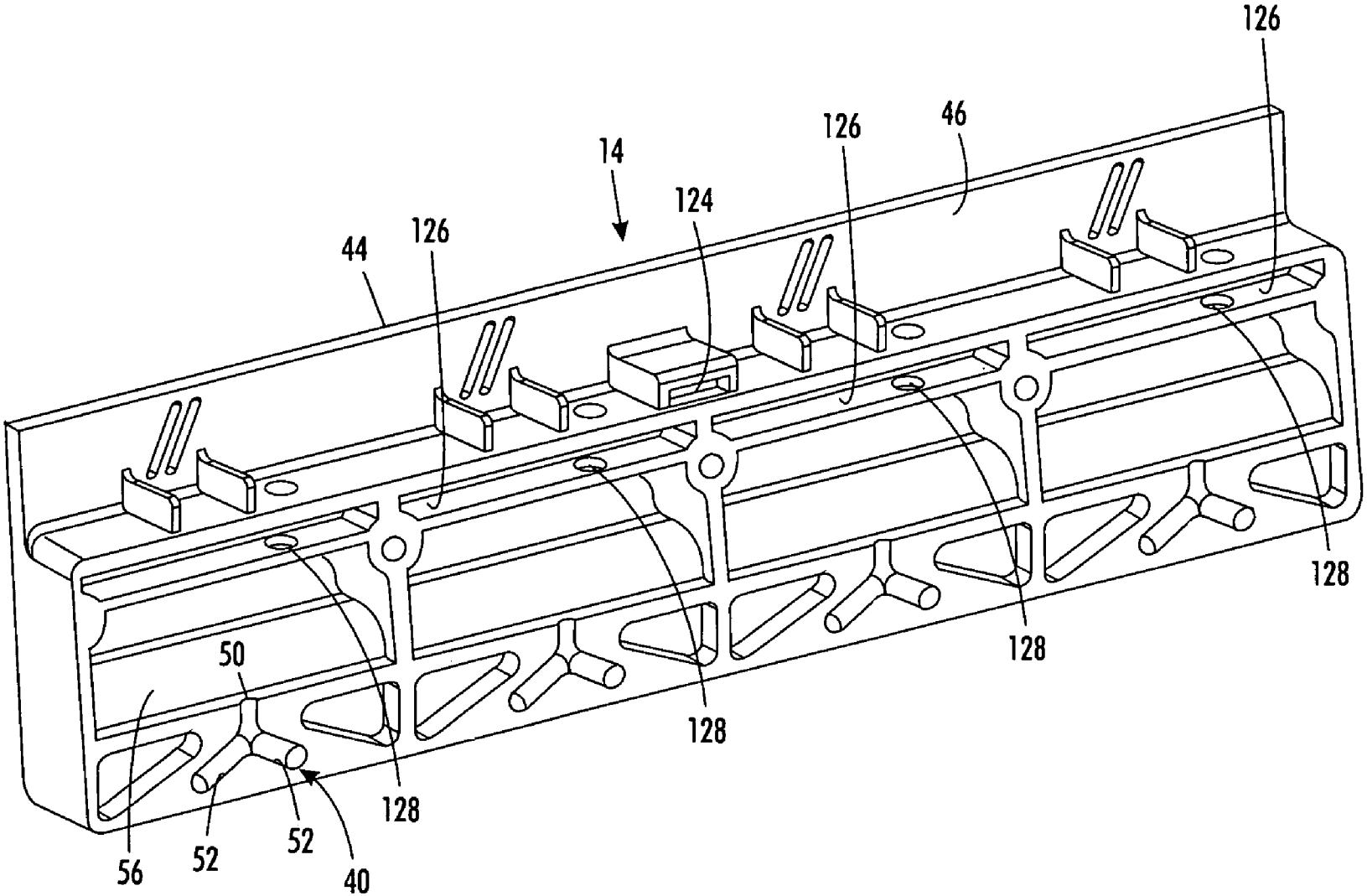
FIG. 4 is a rear perspective view of a middle plate of the print head reservoir of FIG. 1.

Referring to FIG. 4, the middle plate 14 includes a front side 44 and a rear side 46. The front side 44 of the middle plate abuts the front plate 12 and the rear side 46 of the middle plate abuts the front side 20 of the rear plate 16. The middle plate inlet 40 includes three lobed depressions situated 120 degrees apart from one another formed in the rear side 46 of the middle plate 16. Two lobes 52 depend generally downward and the third lobe 50 extends upward to communicate with an ink chamber 56. Ink flows from the ink bucket 26 into the middle plate inlet 40 and into the ink chamber 56 through the upward lobe 50. The ink chamber 56 is defined as a depression in both the rear side 46 of the middle plate 14 and the front side 20 of the rear plate 16, as seen in FIG. 3.

Figure 5:
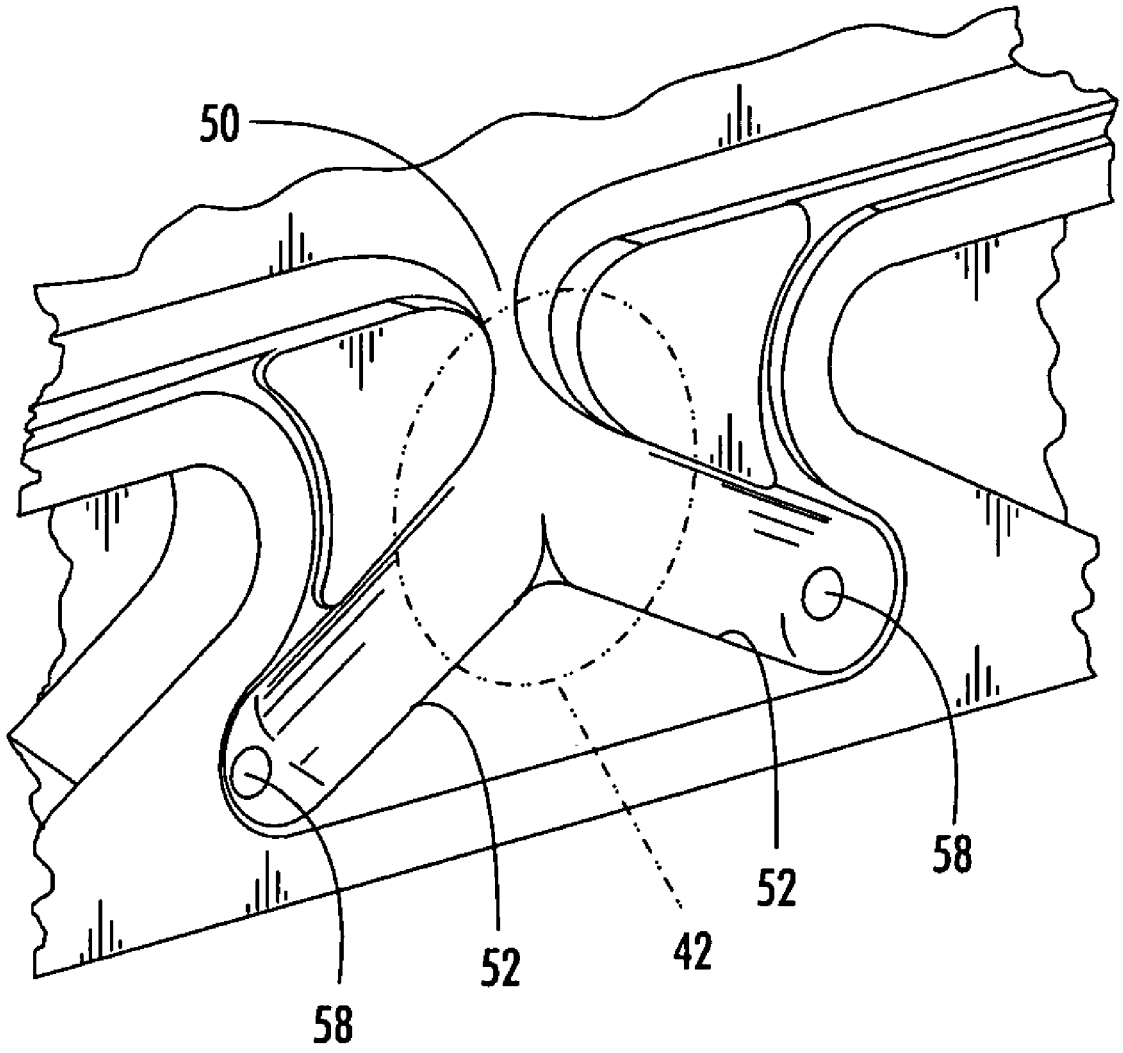
FIG. 5 is a close up view of an inlet of the middle plate of FIG. 4.
Figure 6:
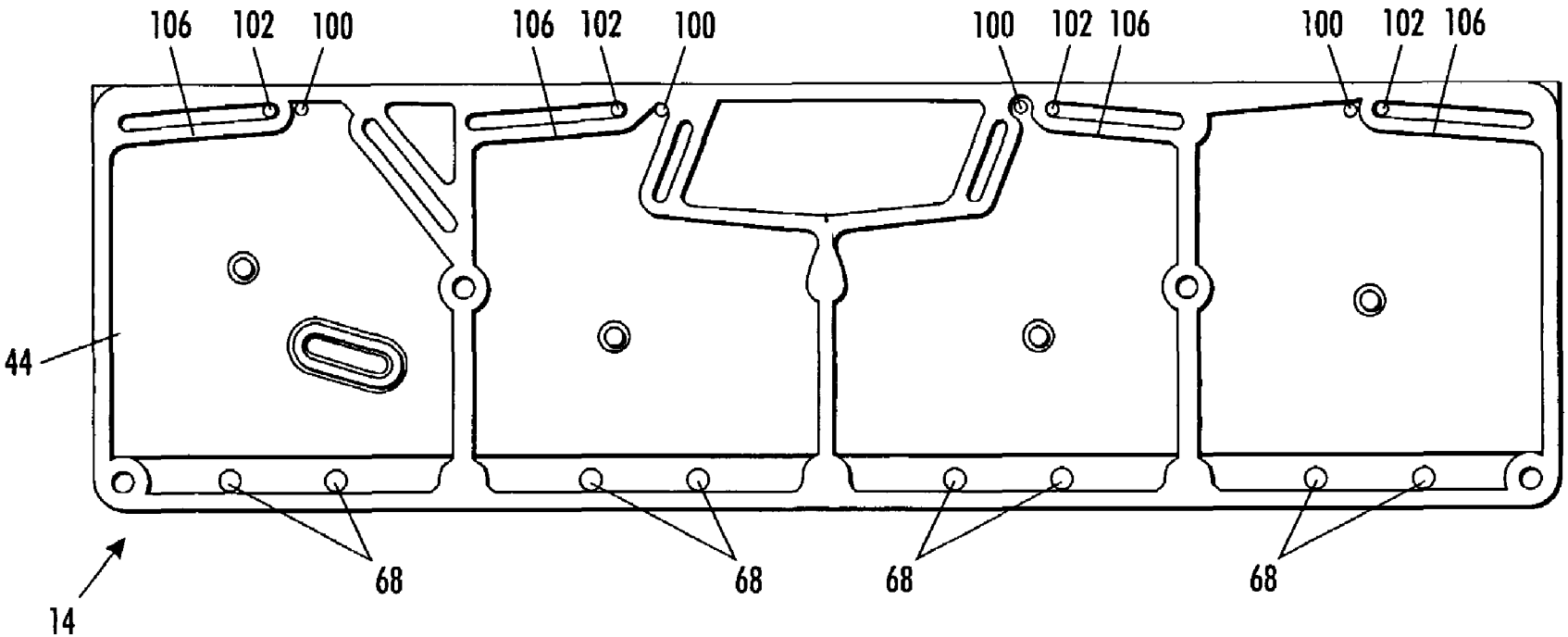
FIG. 6 is an elevation view of the front side of the middle plate of the print head reservoir of FIG. 1.

Ink exits the ink chamber 56 through openings 58 (FIG. 5) in the downward lobes 52. Each downward depending lobe 52 includes an opening 58 that communicates with a passage 64 (only one shown in phantom in FIG. 3) which communicates with a middle plate outlet 68 (FIG. 6) on the front side 44 of the middle plate 14. As seen in FIG. 6, eight middle plate outlets 68 are provided at the bottom of the front side 44 of the middle plate, two for each color of ink. A greater or fewer number of middle plate outlets can be provided. Ink exits the middle plate outlets 68 and enters an upstream filter cavity 74 (FIG. 3).

Since the size of the orifices in the jet stack is so small, the ink is filtered prior to delivery to the ink stack. A vertical filter 76 is sandwiched between and situated substantially parallel to the front plate 12 and the middle plate 14. A vertical filter allows for a more compact print head reservoir 10; however, the filter can be situated at other angles as opposed to vertical. Also, the filter 76 is very fine, so to decrease the pressure drop across the filter the surface area of the filter is maximized. A filter that is at an angle to horizontal provides a larger surface area.

The upstream filter cavity 74 is defined between the front side 44 of the middle plate 14 and the filter 76. As more clearly seen in FIG. 10, the filter 76 includes two layers, a first layer 78 made of a fine screen and a second layer 82 made of a felt material. Other than during a purge cycle, ink flows through the felt layer 82 of the filter 76 first. The felt layer 82 is adjacent the upstream filter cavity 74. Each of the filters can remove impurities as small as 10 microns from the ink. Ink flows through the filter 76 from the upstream filter cavity 74 into a downstream filter cavity 86, which will be described in more detail below.

Figure 7:
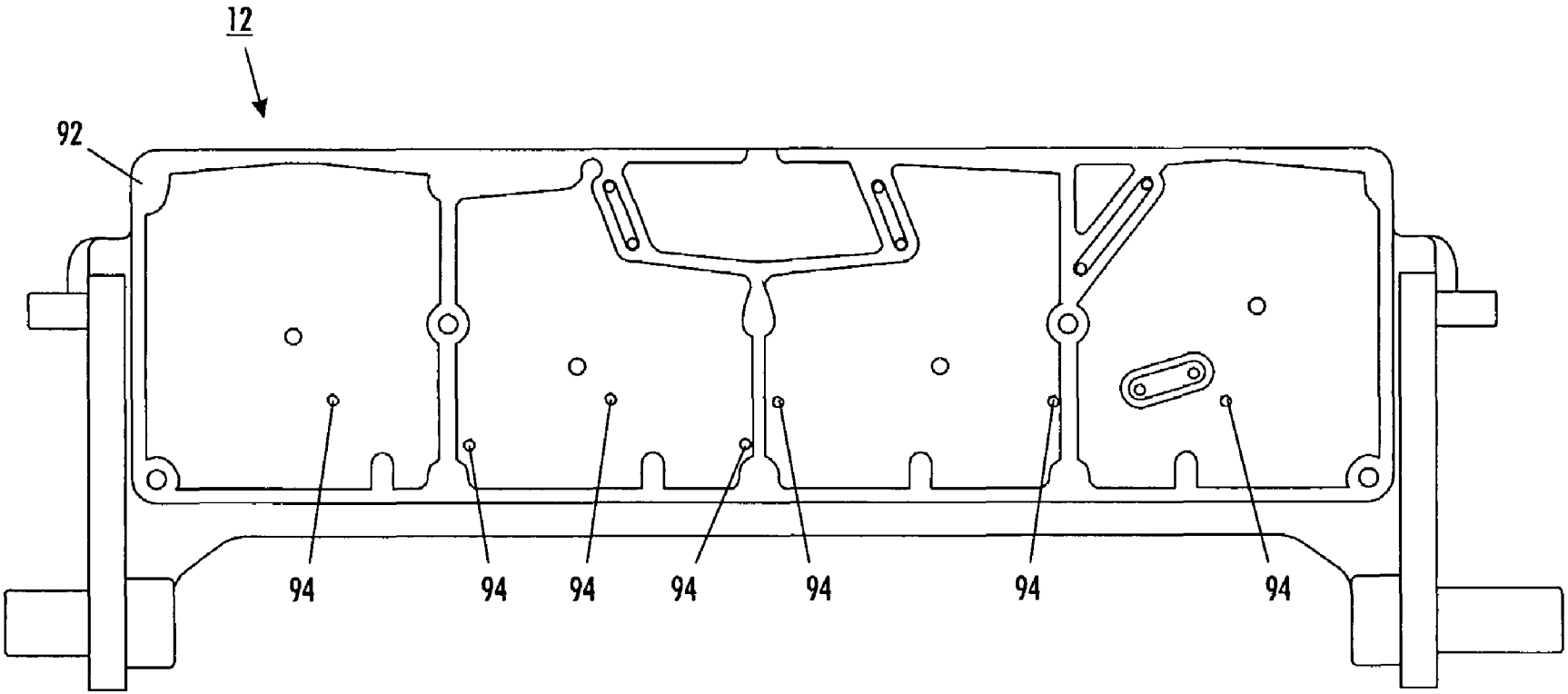
FIG. 7 is an elevation view of the rear side of a front plate of the print head reservoir of FIG. 1.

The front plate 12 includes a front side 90 (FIG. 1) and a rear side 92 (FIG. 7), which is adjacent the filter 76. The downstream filter cavity 86 is defined between the filter 76 and the rear side 92 of the front plate 12. Referring to FIG. 7, the front plate 12 includes a plurality of openings 94 on the rear side 92 that communicate through passages with a plurality of front plate outlets on the front side 90 of the front plate. Ink flows through the filter 76 and into the openings 94. The rear side 92 of the front plate 12 includes four depressions that define the four downstream filter cavities 86, one for each color. As can be seen in FIG. 7, some downstream filter cavities have more than one opening 94, thus on the front side 90 of the front plate 12 more than one plate outlet can be provided for a particular color. Similarly, as seen in FIG. 6, the front side 44 of the middle plate 14 includes four corresponding depressions that define the four upstream filter cavities 74.

Ink flows from the ink buckets 26 towards the front side 90 of the front plate 12 and then on to a jet stack, which is not shown. Ink that flows through the print head reservoir can freeze when the printer is turned off. Large air bubbles can form in the filter cavities 74 and 86 from freeze-thaw cycles when air comes out of the ink solution or from improper ink filling. Trapped air on the upstream side of the filter, i.e. in the upstream ink cavity 74, reduces the effective size of the filter 76. Trapped air on the downstream side, i.e. in the downstream filter cavity 86, can dump bubbles into the flow path during printing which can require additional purges of the ink flow path. With reference to FIG. 6, upstream purge vents 100 and downstream purge vents 102 are provided to bleed any trapped air in the filter cavities 74 and 86. The middle plate outlets 68, which can also can be considered the upstream filter cavity inlet, are positioned below the upstream purge vents 100 so that upward flow of the ink moves trapped air towards the vent.

Figure 8:
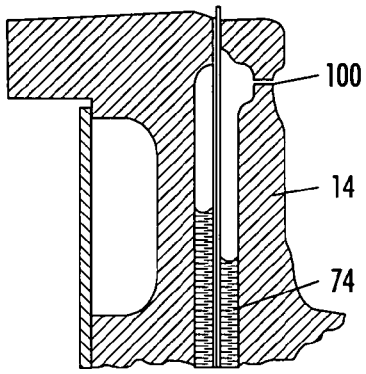
FIG. 8 is a cross-section of the upper portion of the print head reservoir of FIG. 1 showing an upstream purge vent and air pockets in ink cavities of the print head reservoir.
Figure 9:
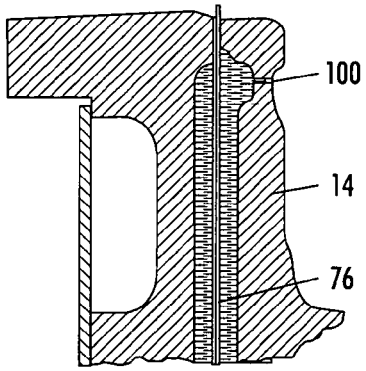
FIG. 9 is a cross-section of the upper portion of the print head reservoir of FIG. 1 showing the upstream purge vent showing the upstream purge vent and air pockets in the ink cavities of the print head reservoir.

As more clearly seen in FIGS. 8 and 9, each upstream vent 100 provides a passageway that can be used to bleed air from each upstream filter cavity 74. Each upstream vent 100 is separated from each downstream vent 102 by a separating wall 106 (FIG. 6) that extends from the front side 44 of the middle plate 14. The separating wall 106 defines an elliptical depression around the downstream purge vent 102 separate from the depression that defines the upstream filter cavity 74. The elliptical depression can compensate for the pressure drop across the filter 76 to accommodate purging the upstream filter cavity 86.

Figure 10:
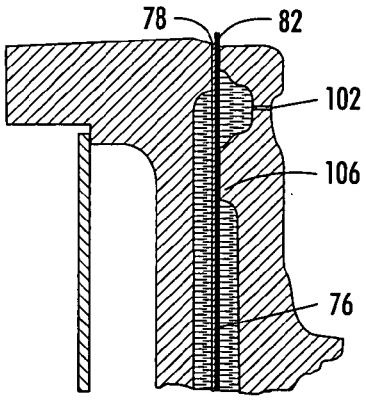
FIG. 10 is a cross-section of the upper portion of the print head reservoir of FIG. 1 showing a downstream purge vent showing an downstream purge vent and air pockets in the ink cavities of the print head reservoir.

The filter 76 can attach to the separating wall 106, as seen in FIG. 10. The felt layer 82 of the filter 76 is removed from the portion of the filter that is on the downstream vent side of the separating wall 106. The felt layer 82 is removed so that felt strands can not obstruct the downstream vent 102 after or during a purge cycle, since the ink would be flowing through the felt layer 78 of the filter 76 last if the felt layer was situated over the elliptical depression. Each of the vents 100 and 102 are located at the top of their respective cavity. Also the vents 100 and 102 are near the apex of sloped walls that define the depressions 74, 86 to encourage the air pockets towards the vents.

Figure 11:
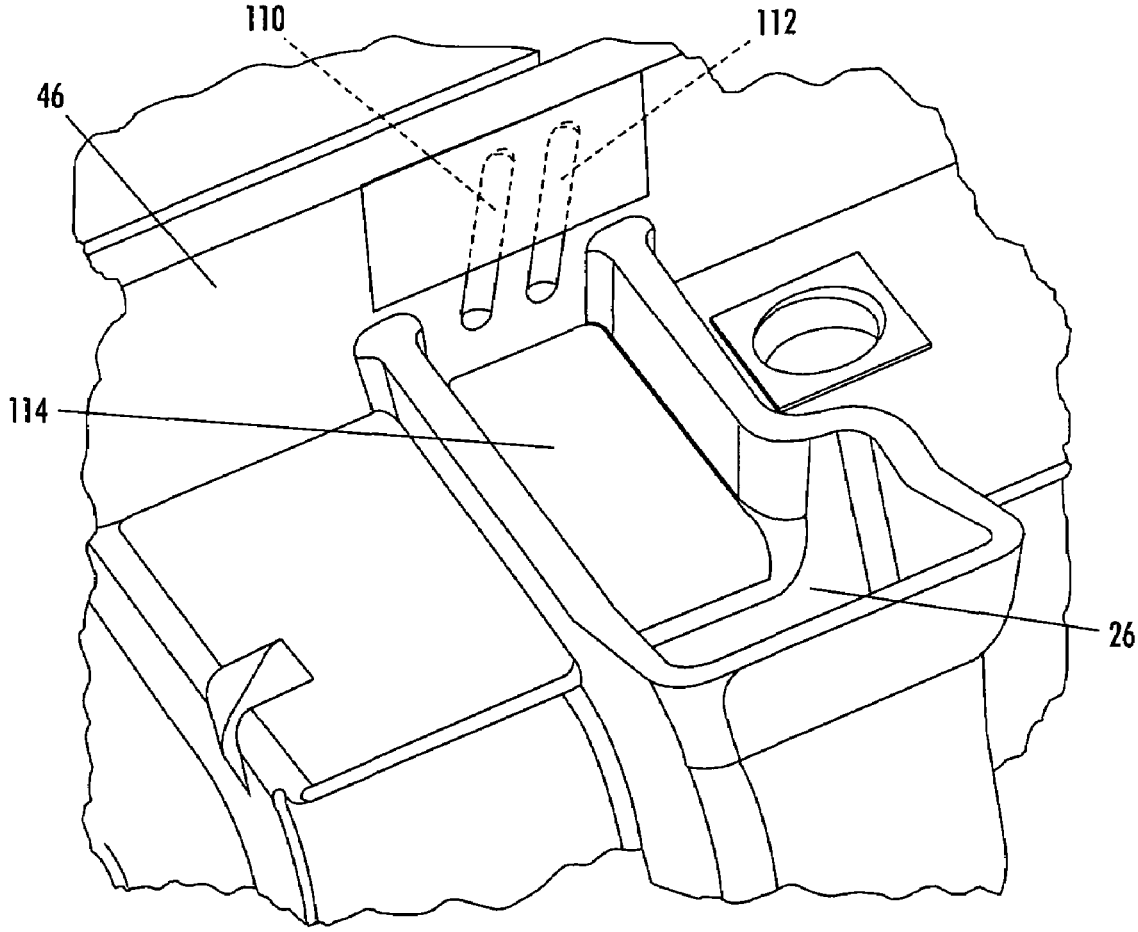
FIG. 11 is a close-up rear perspective view of the upper portion of the print head reservoir of FIG. 1.

With reference to FIG. 11, each of the vents 100 and 102 (not visible in FIG. 11) communicate with a corresponding groove 110 and 112 formed on the rear surface 46 of the middle plate 14. The grooves 110 and 112 lead toward an ink trough 114 that leads toward the ink bucket 26. A piece of tape 116 can be placed over the grooves 110 and 112 to divert ink that leaves the vents 100 and 102 at a high velocity and divert the ink back into the groove towards the ink trough. One example of the tape 116 that can be used is available under the trademark Kapton®.

With reference to FIGS. 8–10, the vents 100 and 102 in the embodiment depicted in the figures are very small. The vents can have a diameter of about 0.0068" and a length of about 0.040", which results in an aspect ratio of nearly 6:1. Preferably, the vents are drilled into the aluminum print head reservoir. The size of the vents is determined by balancing three parameters using dynamic and steady state mathematical models.

First, the diameter of the orifice was maximized to enable the maximum potential air bubble or pocket to be dispersed out of the vent within a short purge cycle. Air pockets can form between the middle plate outlet 68 and the upstream vent 100 in the upstream cavity 74 and the openings 94 on the rear side 92 of the front plate 12 and the downstream vent 102 in the downstream cavity 86. If the air resistance is too high, ink will never reach the vent and an ink meniscus will not form on the vent. If an ink meniscus does not form, the ink level will drop allowing air back into the filter cavities.

Second, the length of the vent was maximized to increase the vent's resistance to ink flow so that a minimum amount of ink is consumed during the purge cycle. Minimizing ink consumption results in greater purge efficiency, and leaves a large volume of ink that can be purged through the remainder of the print head reservoir. The length of the vent was maximized while maintaining an aspect ratio that was able to be manufactured.

Third, the diameter of the vent was minimized, without violating the first parameter above, to provide a meniscus strength that is high enough to retain the ink in the top of the filter cavities during printing. If the pressure drop of the system up to the vents produced by printing and static head height exceeds the meniscus strength, the ink level will drop, allowing air back into the filter cavities.

To purge the filter cavities 74 and 86, air is introduced into the print head reservoir. With reference back to FIG. 1, a fitting 120 attaches to the rear side 22 of the rear plate 16. The fitting 120 connects to an air pressure source (not shown). Referring to FIG. 2, the fitting communicates with a rear plate passage 122 which communicates with a middle plate passage 124. The middle plate passage 124 communicates with a four air plenums 126, one for each color. Each of the plenums 126 includes an opening 128 that leads a respective ink chamber 56. The upper opening aligned with and across from the opening 128 can be covered.

During a purge cycle, air passes through the fitting 120 into the plenums 126 via the passages 122 and 124. From the plenums 126 air travels through the openings 128 into the ink cavities 56. The air pressure in the ink cavities results in a greater pressure on the downstream side of the valve member 42 (FIG. 3), thus closing the valve. The pressure forces ink through the middle plate outlets 68 forcing any air pockets found in the filter cavities 74 and 86 out the vents 100 and 102. Ink that has been forced out the vent hits the tape 116 and flows down the grooves 100 and 112 into the ink trough 114. From the ink trough the ink flows into the ink bucket 26 and is recirculated back into the system.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A print head reservoir comprising a cavity wall that defines a portion of an ink cavity and a filter disposed in the ink cavity dividing the ink cavity into an upstream cavity and a downstream cavity, said cavity wall including a first vent in communication with the upstream cavity, wherein the upstream cavity is in communication with an associated ink source via an ink cavity inlet, said cavity wall including a second vent in communication with the downstream cavity, wherein the downstream cavity is in communication with a jet stack via an ink cavity outlet, each vent comprises an opening extending through said cavity wall having a length at least about six times greater than a diameter of the opening.

2. The print head reservoir of claim 1, wherein at least one of the first vent and the second vent communicates with a recirculation path such that ink expelled from the at least one vent can be recirculated into the ink cavity.

3. The print head reservoir of claim 1, wherein the ink cavity inlet is situated below the first vent.

4. The print head reservoir of claim 1, wherein said filter is situated substantially vertically.

5. The print head reservoir of claim 1, further comprising a separating wall that extends from said cavity wall, wherein said filter attaches to said separating wall.

6. The print head reservoir of claim 1, further comprising an ink bucket in communication with the ink cavity, wherein said ink bucket is in communication with the ink source.

7. The print head reservoir of claim 6, wherein the ink bucket communicates with the ink cavity through a one-way check valve.

8. The print head reservoir of claim 1, wherein the ink cavity communicates with an associated air pressure source.

9. The print head reservoir of claim 1, wherein the cavity wall includes a groove formed on a side of the cavity wall opposite the ink cavity, wherein the groove communicates with the first vent.

10. A print head reservoir for an ink jet printer comprising a body defining a cavity in communication with an associated ink source via an ink path, and a filter disposed in the cavity dividing the cavity into an upstream cavity and a downstream cavity, the body includes a first vent in communication with the upstream cavity and a second vent in communication with the downstream cavity, each vent being in communication with the ink path such that ink that passes through each vent is recirculated into the ink path.

11. The print head reservoir of claim 10, wherein said body includes a wall sloped towards at least one of the first vent and the second vent to encourage air pockets formed in the cavity to move towards at least one of the first vent and the second vent.

12. The print head reservoir of claim 10, wherein said body includes a first plate attached to a second plate, wherein the first plate and the second plate define the cavity.

13. The print head reservoir of claim 12, wherein said filter is positioned substantially parallel to one of the first plate and the second plate.

14. The print head reservoir of claim 12, wherein the first plate includes a wall protruding from the first plate adjacent the vent.

15. The print head reservoir of claim 14, wherein the wall is sloped toward the first vent to encourage air pockets towards the first vent.

16. A print head reservoir for use in an ink jet printer comprising:

a body defining an ink cavity having a cavity inlet, a cavity outlet and a vent, the vent being positioned above the cavity inlet for bleeding air from the ink cavity and the cavity outlet being positioned above the cavity inlet;

an ink bucket attached to said body, said ink bucket in fluid communication with said cavity via the cavity inlet; and a non-horizontal filter disposed in the cavity dividing the cavity into an upstream filter cavity and a downstream filter cavity.

17. The print head reservoir of claim 16, further comprising a bucket wall extending from said body to define said ink bucket.

18. The print head reservoir of claim 16, wherein said non-horizontal filter is vertically disposed in the cavity.

19. The print head reservoir of claim 16, wherein the vent is dimensioned using models to maximize a diameter to decrease resistance to airflow, to minimize a length to increase resistance to ink flow and to maximize the diameter to increase meniscus strength so that ink is retained near a top portion of the ink cavity.

* * * * *